US007823496B2

(12) United States Patent
Bosman et al.

(10) Patent No.: US 7,823,496 B2
(45) Date of Patent: Nov. 2, 2010

(54) ROPE CONTAINING HIGH-PERFORMANCE POLYETHYLENE FIBRES

(75) Inventors: Rigobert Bosman, Landgraaf (NL); Berend A. Drogt, Geleen (NL)

(73) Assignee: DSM IP Assets B.V., Heerlen (NL)

( * ) Notice: Subject to any disclaimer, the term of this patent is extended or adjusted under 35 U.S.C. 154(b) by 0 days.

(21) Appl. No.: 12/095,793

(22) PCT Filed: Nov. 28, 2006

(86) PCT No.: PCT/EP2006/011404

§ 371 (c)(1),
(2), (4) Date: Oct. 14, 2008

(87) PCT Pub. No.: WO2007/062803

PCT Pub. Date: Jun. 7, 2007

(65) Prior Publication Data

US 2009/0165637 A1 Jul. 2, 2009

(30) Foreign Application Priority Data

Dec. 2, 2005 (EP) ..... 05077750

(51) Int. Cl.
*D04C 1/02* (2006.01)

(52) U.S. Cl. ..... 87/9; 57/210

(58) Field of Classification Search ..... 87/6, 87/7, 8, 9; 57/210
See application file for complete search history.

(56) References Cited

U.S. PATENT DOCUMENTS 4,099,750 A * 7/1978 McGrew ..... 289/1.5
4,567,917 A * 2/1986 Millard ..... 138/126
4,974,488 A * 12/1990 Spralja ..... 87/8
5,061,561 A 10/1991 Katayama
5,794,504 A * 8/1998 Starbile ..... 87/1
6,945,153 B2 * 9/2005 Knudsen et al. ..... 87/1
7,168,231 B1 * 1/2007 Chou et al. ..... 57/210
2006/0179812 A1 * 8/2006 Clough et al. ..... 57/210
2006/0182962 A1 * 8/2006 Bucher et al. ..... 428/364
2006/0207414 A1 * 9/2006 Nye ..... 87/7
2007/0079695 A1 * 4/2007 Bucher et al. ..... 87/8

FOREIGN PATENT DOCUMENTS

EP 1 306 471 5/2003
JP 03 249289 11/1991
WO 2006/086338 8/2006
WO WO 2006133881 A2 * 12/2006
WO WO 2007062803 A1 * 6/2007

OTHER PUBLICATIONS

International Search Report dated Mar. 16, 2007.
Written Opinion of the International Searching Authority dated Mar. 16, 2007.

* cited by examiner

*Primary Examiner*—Shaun R Hurley
(74) *Attorney, Agent, or Firm*—Nixon & Vanderhye P.C.

(57) ABSTRACT

The invention relates to a rope containing a plurality of strands comprising a mixture of high-performance polyethylene fibres and polytetrafluoroethylene fibres in a mass ratio of 70:30 to 98:2. The rope shows markedly improved service life performance in cyclic bend-over-sheave applications. The invention also relates to the use of said rope as a load-bearing member in bend-over-sheave applications.

10 Claims, 3 Drawing Sheets

ROPE CONTAINING HIGH-PERFORMANCE POLYETHYLENE FIBRES

This application is the U.S. national phase of International Application No.

PCT/EP2006/011404 filed 28 Nov. 2006 which designated the U.S. and claims priority to European Application No. 05077750.7 filed 2 Dec. 2005, the entire contents of each of which are hereby incorporated by reference.

FIELD

The invention relates to a rope comprising high-performance polyethylene fibres, which rope is especially suited for bend-over-sheave applications. The invention also relates to the use of said rope as a load-bearing member in bend-over-sheave applications.

BACKGROUND AND SUMMARY

Such a rope is known from U.S. Pat. No. 5,901,632. In this patent publication a large-diameter braided rope is described, which rope contains a plurality of strands that themselves have been braided, preferably from rope yarns containing high-strength polymer fibres. In the most preferred embodiments indicated, the rope is a 12-strand, two-over/two-under circular braid, wherein each strand is itself a 12-strand braid made from high-performance polyethylene (HPPE) fibres (12×12 construction).

A rope for bend-over-sheave applications is within the context of the present application considered to be a load-bearing rope typically used in lifting and mooring applications; such as marine, oceanographic, offshore oil and gas, seismic, commercial fishing and other industrial markets. During such uses, together referred to as bend-over-sheave applications, the rope is frequently pulled over drums, bitts, pulleys, sheaves, etc., a.o. resulting in rubbing and bending. When exposed to such frequent bending or flexing, a rope may fail due to rope and fibre damage resulting from external and internal abrasion, frictional heat, etc.; such fatigue failure is often referred to as bending fatigue or flex fatigue, To reduce flex fatigue of a rope in bend-over-sheave applications, use of a sheave (or other surface) with a diameter of at least 8 times the rope diameter is generally advised. In order to reduce loss of strength in a rope resulting from external abrasion, it is known to provide a jacket, for example a woven or braided sleeve, to the rope or to the strands in the rope. These jackets, however, increase rope diameter and stiffness, and add weight and cost, but do not contribute to the load bearing capacity of the rope; and direct visual inspection of the load bearing elements is not possible. In order to reduce a.o. loss of strength resulting from internal abrasion between the fibres in the rope, applying a specific mixture of polymer fibres in the rope strands is proposed in U.S. Pat. No. 6,945,153 B2.

The U.S. Pat. No. 6,945,153 B2 publication describes a braided rope of construction analogous to U.S. Pat. No. 5,901,632, wherein the strands contain a mixture of high-performance polyethylene fibres and lyotropic or thermotropic polymer fibres, in a ratio of 40:60 to 60:40. The lyotropic or thermotropic liquid crystalline fibres, like aromatic polyamides (aramids) or polybisoxazoles (PBO) are indicated to provide good resistance to creep rupture, but to be very susceptible to self-abrasion; whereas HPPE fibres are mentioned to exhibit the least amount of fibre-to-fibre abrasion, but to be prone to creep failure.

A drawback of known ropes, however, remains a limited service life when exposed to frequent bending or flexing. Accordingly, there is a need in industry for ropes that show improved performance in cyclic bend-over-sheave applications during prolonged times.

The object of the invention is therefore to provide such a rope showing improved performance.

This object is achieved according to the invention with a rope containing a plurality of strands comprising a mixture of high-performance polyethylene (HPPE) fibres and polytetrafluoroethylene (PTFE) fibres in a mass ratio of 70:30 to 98:2 for the rope in total.

Surprisingly a rope having an optimum of properties is obtained. The rope has an improved flex fatigue and yet still has a high stiffness and high strength.

The rope according to the invention shows markedly improved service life performance in cyclic bend-over-sheave applications, which is surprising because, although PTFE as such is known for among others its lubricating properties, in for example U.S. Pat. No. 6,945,153 B2 it is clearly stated that HPPE yarns would already show the best abrasion performance in ropes.

Other advantages of the rope according to the invention include that less heat, for example as a result of inter strand and/or inter fibre friction, is generated during use; which lowers the risk that the HPPE fibres show creep elongation. A rope comprising a high amount of HPPE fibres can thus be safely applied in long-term applications provided it is properly designed and used; for example by preventing overloading situations (versus maximum design capacity). The rope has high strength efficiency, meaning the strength of the rope is a relatively high percentage of the strength of its constituting fibres. The rope also shows good performance on traction and storage winches, and can be easily inspected on possible damage.

The present invention therefore also relates to the use of a rope of construction and composition as further detailed in this application as a load-bearing member in bend-over-sheave applications, for example in hoisting applications.

DETAILED DESCRIPTION

Figure 1:
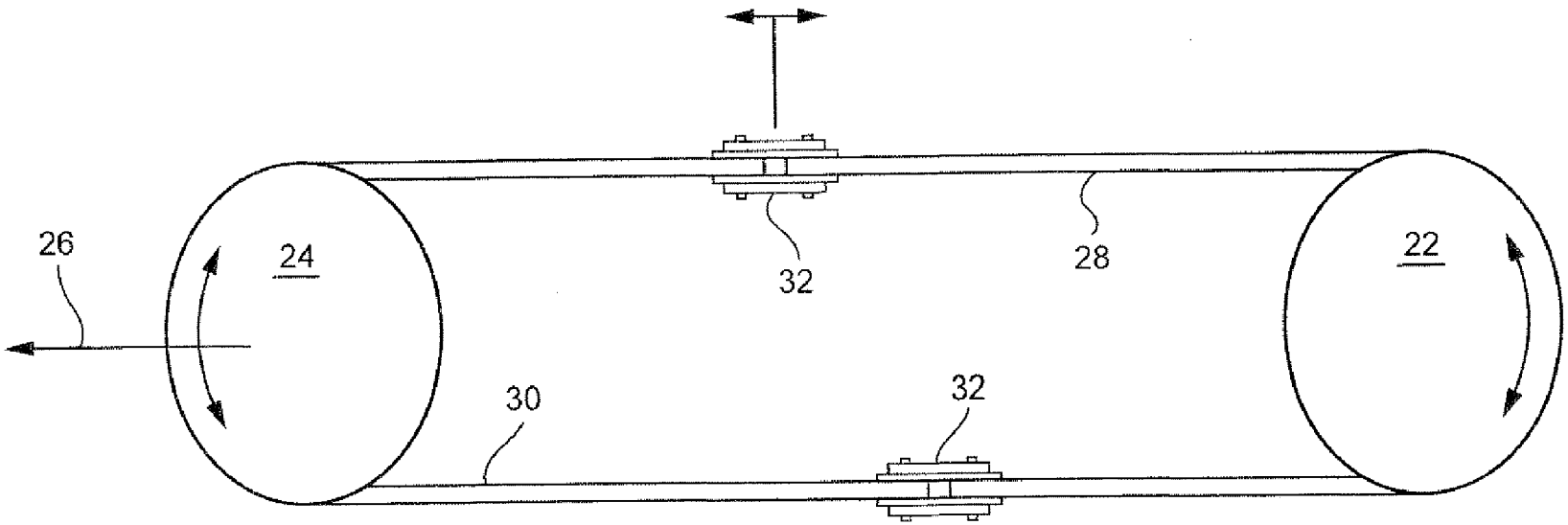
FIG. 1 depicts a test apparatus for testing the flex fatigue of a rope.

The rope according to the invention can be of various constructions, including laid, braided, parallel (with cover), and wire rope-like constructed ropes. The number of strands in the rope may also vary widely, but is generally at least 3 and preferably at most 16, to arrive at a combination of good performance and ease of manufacture.

Preferably, the rope according to the invention is of a braided construction, to provide a robust and torque-balanced rope that retains its coherency during use. There is a variety of braid types known, each generally distinguished by the method that forms the rope. Suitable constructions include soutache braids, tubular braids, and flat braids. Tubular or circular braids are the most common braids for rope applications and generally consist of two sets of strands that are intertwined, with different patterns possible. The number of strands in a tubular braid may vary widely. Especially if the number of strands is high, and/or if the strands are relatively thin, the tubular braid may have a hollow core; and the braid may collapse into an oblong shape. If this is not desired, the braid may contain a core member, which can be a rope made from various polymer fibres, preferably HPPE fibres; which braid will better retain its shape during use.

The number of strands in a braided rope according to the invention is at least 3. An increasing number of strands tends to lower the strength efficiency of the rope. The number of strands is therefore preferably at most 16, depending on the type of braid. Particularly suitable are ropes of an 8- or 12-strand braided construction. Such ropes provide a favourable combination of tenacity and resistance to flex fatigue, and can be made economically on relatively simple machines.

The rope according to the invention can be of a construction wherein the twist factor (the number of turns per meter in a laid construction) or the braiding period (that is the pitch length related to the width of a braided rope) is not specifically critical. Suitable braiding periods are in the range of from 4 to 20. A higher braiding period may result in a more loose rope having higher strength efficiency, but which is less robust and more difficult to splice. Too low a braiding period would reduce tenacity too much. Preferably therefore, the braiding period is about 5-15, more preferably 6-10.

The rope according to the invention may have a diameter that varies between wide limits. Preferably the rope has a diameter of at least 2 mm, more preferably of at least 5 mm, even more preferably of at least 10 mm. Smaller diameter ropes, for example in the range of from 2 to 20 mm, are typically applied as cords in mechanical devices; such as an automotive door window lifting mechanism. Most preferably the rope has a large diameter of at least 20 mm. In case of a rope with an oblong cross-section, it is more accurate to define the size of a round rope by an equivalent diameter; that is the diameter of a round rope of same mass per length as the non-round rope. The diameter of the rope is measured at the outmost circumference of the rope. This is because of irregular boundaries of ropes defined by the strands. Preferably, the rope according to the invention is a heavy-duty rope having an equivalent diameter of at least 30 mm, more preferably at least 40, 50, 60, or even at least 70 mm, since the advantages of the invention become more relevant the larger the rope. Largest ropes known have diameters up to about 300 mm, ropes used in deepwater installations typically have a diameter of up to about 130 mm.

The rope according to the invention can have a cross-section that is about circular or round, but also an oblong cross-section, meaning that the cross-section of a tensioned rope shows a flattened, oval, or even (depending on the number of primary strands) an almost rectangular form. Such oblong cross-section preferably has an aspect ratio, i.e. the ratio of the larger to the smaller diameter (or width to height ratio), in the range of from 1.2 to 4.0. Methods to determine the aspect ratio are known to the skilled person; an example includes measuring the outside dimensions of the rope, while keeping the rope taut, or after tightly winding an adhesive tape around it. The advantage of said aspect ratio is that during cyclic bending less stress differences occur between the filaments in the rope, and less abrasion and frictional heat occurs, resulting in enhanced bending fatigue life. The cross-section preferably has an aspect ratio of about 1.3-3.0, more preferably about 1.4-2.0.

In the rope according to the invention the construction of the strands, also referred to as primary strands, is not specifically critical. The skilled person can select suitable constructions like laid or braided strands, and twist factor or braiding period respectively, such that a balanced and torque-free rope results.

In a special embodiment of the invention each primary strand is itself a braided rope. Preferably, the strands are circular braids made from an even number of secondary strands, also called rope yarns, which comprise polymer fibres. The number of secondary strands is not limited, and may for example range from 6 to 32; with 8, 12 or 16 being preferred in view of available machinery for making such braids. The skilled man in the art can choose the type of construction and titer of the strands in relation to the desired final construction and size of the rope, based on his knowledge or with help of some calculations or experimentation.

The secondary strands or rope yarns containing polymer fibres can be of various constructions, again depending on the desired rope. Suitable constructions include twisted fibres; but also braided ropes or cords, like a circular braid, can be used. Suitable constructions are for example mentioned in U.S. Pat. No. 5,901,632.

Within the context of the present invention, fibres are understood to mean elongated bodies of indefinite length and with length dimension much greater than width and thickness. The term fibre thus includes a monofilament, a multifilament yarn, a ribbon, a strip or tape and the like, and can have regular or irregular cross-section. The term fibres also includes a plurality of any one or combination of the above.

Fibres having the form of monofilaments or tape-like fibres can be of varying titer, but typically have a titer in the range of 10 to several thousand dtex, preferably in the range of 100 to 2500 dtex, more preferably 200-2000 dtex. Multi-filament yarns contain a plurality of filaments having a titer typically in the 0.2-25 dtex range, preferably about 0.5-20 dtex. The titer of a multifilament yarn may also vary widely, for example from 50 to several thousand dtex, but is preferably in the range of about 200-4000 dtex, more preferably 300-3000 dtex.

The rope according to the invention contains a plurality of strands comprising high-performance polyethylene (HPPE) fibres. HPPE fibres are herein understood to be fibres made from ultra-high molar mass polyethylene (also called ultra-high molecular weight polyethylene; UHMWPE), and having a tenacity of at least 2.0, preferably at least 2.5 or at least 3.0 N/tex. Tensile strength, also simply strength, or tenacity of fibres are determined by known methods, as based on ASTM D885-85 or D2256-97. There is no reason for an upper limit of tenacity of HPPE fibres in the rope, but available fibres typically are of tenacity at most about 5 to 6 N/tex. The HPPE fibres also have a high tensile modulus, e.g. of at least 75 N/tex, preferably at least 100 or at least 125 N/tex. HPPE fibres are also referred to as high-modulus polyethylene fibres.

In a preferred embodiment, the HPPE fibres in the rope according to the invention are one or more multi-filament yarns.

HPPE fibres, filaments and multi-filament yarn, can be prepared by spinning of a solution of UHMWPE in a suitable solvent into gel fibres and drawing the fibres before, during and/or after partial or complete removal of the solvent; that is via a so-called gel-spinning process. Gel spinning of a solution of UHMWPE is well known to the skilled person; and is described in numerous publications, including EP 0205960 A, EP 0213208 A1, U.S. Pat. No. 4,413,110, GB 2042414 A, EP 0200547 B1, EP 0472114 B1, WO 01/73173 A1, and in Advanced Fiber Spinning Technology, Ed. T. Nakajima, Woodhead Publ. Ltd (1994), ISBN 1-855-73182-7, and in references cited therein.

UHMWPE is understood to be polyethylene having an intrinsic viscosity (IV, as measured on solution in decalin at 135° C.) of at least 5 dl/g, preferably of between about 8 and 40 dl/g. Intrinsic viscosity is a measure for molar mass (also called molecular weight) that can more easily be determined than actual molar mass parameters like $M_n$ and $M_w$. There are several empirical relations between IV and $M_w$, but such relation is dependent on molar mass distribution. Based on the equation $M_w=5.37*10^4\ [IV]^{1.37}$ (see EP 0504954 A1) an IV of 8 dl/g would be equivalent to $M_w$ of about 930 kg/mol. Preferably, the UHMWPE is a linear polyethylene with less than one branch per 100 carbon atoms, and preferably less than one branch per 300 carbon atoms; a branch or side chain or chain branch usually containing at least 10 carbon atoms. The linear polyethylene may further contain up to 5 mol % of one or more comonomers, such as alkenes like propylene, butene, pentene, 4-methylpentene or octene.

In a preferred embodiment, the UHMWPE contains a small amount, preferably at least 0.2, or at least 0.3 per 1000 carbon atoms, of relatively small groups as pending side groups, preferably a C1-C4 alkyl group. Such a fibre shows an advantageous combination of high strength and creep resistance. Too large a side group, or too high an amount of side groups, however, negatively affects the process of making fibres. For this reason, the UHMWPE preferably contains methyl or ethyl side groups, more preferably methyl side groups. The amount of side groups is preferably at most 20, more preferably at most 10, 5 or at most 3 per 1000 carbon atoms.

The HPPE fibres in the rope according to the invention may further contain small amounts, generally less than 5 mass %, preferably less than 3 mass % of customary additives, such as anti-oxidants, thermal stabilizers, colorants, flow promoters, etc. The UHMWPE can be a single polymer grade, but also a mixture of two or more different polyethylene grades, e.g. differing in IV or molar mass distribution, and/or type and number of comonomers or side groups.

The rope according to the invention contains a plurality of strands comprising a mixture of HPPE and PTFE fibres. PTFE fibres are herein understood to be fibres made from polytetrafluoropolyethylene polymer. The PTFE fibres have a tenacity that is significantly lower than the HPPE fibres, and have not effective contribution to the static tenacity of the rope. Nevertheless, the PTFE fibres preferably have a tenacity of at least 0.3, preferably at least 0.4 or at least 0.5 N/tex, in order to prevent breaking of fibres during handling, mixing with HPPE fibres and/or during rope making. There is no reason for an upper limit of the tenacity of PTFE fibres, but available fibres typically are of tenacity of at most about 1 N/tex. The PTFE fibres typically have an elongation at break that is higher than that of HPPE fibres.

Properties of PTFE fibres and methods of making such fibres have been described in numerous publications, including EP 0648869 A1, U.S. Pat. No. 3,655,853) U.S. Pat. No. 3,953,566, U.S. Pat. No. 5,061,561, U.S. Pat. No. 6,117,547, and U.S. Pat. No. 5,686,033.

PTFE polymer is understood to be a polymer made from tetrafluoroethylene as main monomer. Preferably, the polymer contains less than 4 mole %, more preferably less than 2 or 1 mole % of other monomers, such as ethylene, chlorotrifluoroethylene, hexafluoropropylene, perfluoropropyl vinylether and the like. PTFE is generally a very high molar mass polymer, with high melting point and high crystallinity, which makes it virtually impossible to melt process the material. Also its solubility in solvents is very limited. PTFE fibres are therefore typically made by extruding mixtures of PTFE and optionally other components below the melting point of PTFE into a precursor fibre, for example a monofilament, tape or sheet, followed by sintering-like processing steps, and/or post-stretching the products at elevated temperatures. PTFE fibres are thus typically in the form of one or more monofilament- or tape-like structures, for example some tape-like structures twisted into a yarn-like product. PTFE fibres generally have certain porosity, depending on the process applied for making a precursor fibre and on applied post-stretching conditions. Apparent densities of PTFE fibres can vary widely, suitable products have densities in the range of about 1.2 to 2.5 g/cm$^3$.

The rope according to the invention preferably HPPE fibres and PTFE fibres have been combined to form rope yarns, which form the strands in the rope. All primary and secondary strands in the rope according to the invention may contain about the same mass ratio of HPPE to PTFE, but said ratio may also be different for said strands (the average mass ratio for the rope in total being in the indicated range). In one embodiment, the PTFE fibres are specifically present in those rope yarns of a strand that are in direct contact with other strands; with rope yarn hidden inside a strand consisting essentially of HPPE. It is also possible that the rope according to the invention contains a plurality of strands comprising the HPPE fibers and the PTFE fibers and further one or more strands consisting of HPPE fibers, further fibers not being PTFE fibers, or of a mixture of HPPE fibers and further fibers. Such strands preferably are the core of the rope.

The rope according to the invention contains a plurality of strands comprising a mixture of HPPE fibres and PTFE fibres in a mass ratio of 70:30 to 98:2. A higher content of PTFE fibres will add more lubricating action to the strands and increase the service life when exposed to frequent bending of rope. Preferably, the mass ratio of HPPE fibres to PTFE fibres is at most 97:3, more preferably at most 96:4, 95:5, 94:6, 93:7 or even 92:8. However, since the PTFE fibres do not or hardly contribute to the strength of the rope, their amount should not become too high. Preferably, the mass ratio of HPPE fibres and PTFE fibres is therefore at least 74:26, 78:22, 80:20, or even 82:18.

The primary strands in the rope according to the invention may in addition to said mixture of fibres further contain other components; like other fibres, coatings and the like. Preferably, the strands contains at most 25 mass %, more preferably at most 20 or 15 mass % of other components.

The rope according to the invention containing primary strands means that the primary strands are the main constituents giving the rope its load-bearing properties. The rope may further comprise auxiliary components to further enhance performance or give it some additional properties, as would be known to a skilled person. Examples include some auxiliary rope strand or fibre with e.g. electrically conductive or light transmitting properties, a change in which property may serve for example as an indicator for an overload situation to have occurred. The rope can also further comprise any customary coating or sizing, which coating may protect the rope or act as lubricant to further enhance resistance to abrasion. Coating materials suitable for such purpose are generally applied as aqueous dispersions, for example of thermoplastic polymers or bituminous compounds. Preferably, the rope contains less than about 25, or less than 20 or 15 mass % of other components.

A braided rope of about 5 mm diameter made from HPPE multifilament yarns was evaluated with a reversed bending test, using 3 rollers resulting in 6 bending deformations per cycle. The test is performed under ambient conditions, with water being sprayed onto the rope. The rope showed a resistance to cyclic bending (bending fatigue life) of about 400 cycles before failure occurred. Repeating the test with two other pieces of the same rope, but now provided with about 15 mass % of two coating materials, one based on bituminous compounds and the other based on silicone compounds resulted in about 1000 and 1300 cycles to failure, respectively. A rope of similar construction is made, wherein the strands consist of a mixture of about 86 mass % HPPE yarn and about 14 mass % of tape-like PTFE fibre of dimensions typical for use as e.g. dental floss. Without any coatings applied, this rope fails after some 5000 cycles. The same HPPE/PTFE rope coated with a silicone coating (about 11 mass % of silicone compounds based on total rope mass) shows not yet failure after 15000 cycles.

The invention further relates to a rope containing a plurality of strands comprising a mixture of high-performance polyethylene fibres and polytetrafluoroethylene fibres in a mass ratio of 70:30 to 98:2, which rope further contains from about 2 to 20 mass % of silicone compounds (based on total rope mass). Such a rope shows a surprisingly high further improvement in bending fatigue life time, in combination with favourable strength properties, and resistance to abrasion.

Preferably, the rope according to the invention contains about 3-18, 4-16 or even about 5-15 mass % of silicone compounds.

The term silicone compounds is used herein for compounds in which silicon atoms are linked via oxygen atoms, each silicon atom bearing one or several organic groups, usually methyl or phenyl. The silicones are also known as polyorganosiloxanes, and can be linear, cyclic or a mixture thereof. Silicone compounds like polyorganosiloxanes can be produced by reacting for example organodichlorosilanes with water according to known methods.

In a special embodiment of the invention, the rope has been post-stretched, or at least its primary strands have been post-stretched before assembling into the rope, preferably at a temperature in the range 100-120° C.; to further increase the strength properties of the rope. Such a rope post-stretching step is described in a.o. EP 0398843 B1 or U.S. Pat. No. 5,901,632.

The invention also relates to the use of PTFE fibres, in combination with other polymer fibres for making ropes. PTFE fibres are used in numerous demanding applications due to the good physical properties of PTFE. It has excellent high and low temperature performance, chemical resistance, and resistance to damage as a result of exposure to ultraviolet radiation. Exemplary applications of PTFE fibres include use as dental floss, bearings, and various membranes and waterproof yet breathable fabrics, formed from a wide array of textile processes including weaving, braiding, knitting and needle-punching. PTFE fibres are also used as a sewing thread, but use in ropes has not been published. The PTFE fibres surprisingly increase the service life of ropes, especially of ropes of larger diameter that are frequently bended during use.

Preferably the use according to the invention relates to applying PTFE fibres in combination with high-performance fibres having a tenacity of at least 2.0 N/tex in making ropes for bend-over-sheave applications; wherein the mass ratio of other fibres to PTFE fibres is from 70:30 to 98:2. More preferably, the high-performance fibres are HPPE fibres.

The rope according to the invention can be made with known techniques for assembling a rope from polymer fibres, and optionally applying a rope coating.

A preferred method for making a rope according to the invention comprises the steps of a) assembling HPPE fibres and PTFE fibres in a mass ratio of 70:30 to 98:2 to form rope yarns, b) optionally assembling two or more of said rope yarns to form strands, c) braiding said rope yarns or said strands to form a rope, and d) optionally applying a rope coating.

Preferred embodiments of the method according to the invention are analogous to those discussed above for construction and/or composition of the fibres, rope yarns, strands and coating.

The method according to the invention may further comprise a step of splicing the end of one primary strand to an end of a next primary strand, for example when during braiding a carrier containing the strand runs empty. This way the length of the rope can be extended to any desired length, without the resulting rope containing weak spots that would lead to lower breaking strength.

The method according to the invention may also further comprise a step of post-stretching the primary strands before the braiding step, or alternatively a step of post-stretching the rope. Such is stretching step is preferably performed at elevated temperature but below the melting point of the (lowest melting) filaments in the stands (=heat-stretching); preferably at temperatures in the range 100-120° C. Such a post-stretching step is described in a.o. EP 398843 B1 or U.S. Pat. No. 5,901,632.

Surprisingly the rope according to the invention, containing the HPPE fibers shows a better flex fatigue than those ropes known before. Therefore the invention also relates to a rope comprising HPPE fibers and at least one means to improve the flex fatigue of the rope, characterized in that flex fatigue is improved with at least a factor of 5 compared to the rope not comprising the means to improve the flex fatigue. Preferably the flex fatigue is improved with at least a factor of 7, more preferably a factor of 10, even more preferably a factor of 13. With respect to preferred embodiments, as for example the type and amount of HPPE fibers used, the diameter of the rope etc., the same preferences count as defined above, for the rope containing the HPPE fibers and the PTFE fibers.

Method for Testing the Flex Fatigue of a Rope

Figure 2:
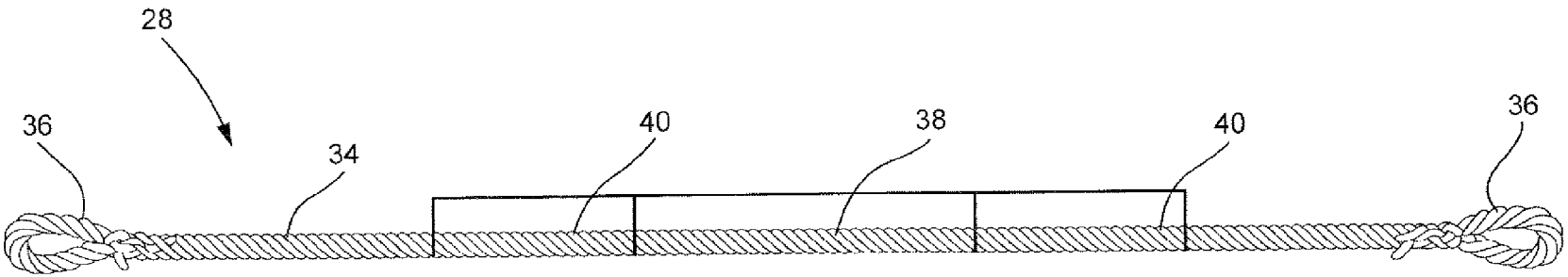
FIG. 2 depicts a test specimen that is used in the test apparatus shown in FIG. 1.

The method for testing the flex fatigue of a rope is described in U.S. Pat. No. 6,945,153 B2. The test apparatus and the test specimen as disclosed in this patent are shown in FIG. 1 and FIG. 2, respectively. FIG. 1 shows test apparatus 20, which apparatus has a test sheave 22 and a tensioning sheave 24. A force 26 is applied to sheave 24 to result in a tension in the test specimen and a surface tension at the interface between specimen and sheave. First test specimen 28 and second test specimen 30 are placed on the sheaves and their free ends are joined together with a coupler 32. Test specimen 28 is illustrated in FIG. 2. Specimen 28 consists of a rope a portion 34 and eye splices 36 at each end of the rope portion. The rope portion include a double bend zone 38 and two single bend zones 40, located at either side of zone 38.

The sheaves are in one cycle rotated in one direction until the couplers reach the sheaves and than rotated in the other direction until the couples reach the sheaves again. In this way the double bend zone 38 passes twice the sheave. This was continuous repeated in a frequency of 554 cycles per hour, corresponding to a cycling period of 6.5 seconds.

The diameter of the sheaves is 20 times the diameter of the tested rope.

Figure 3:
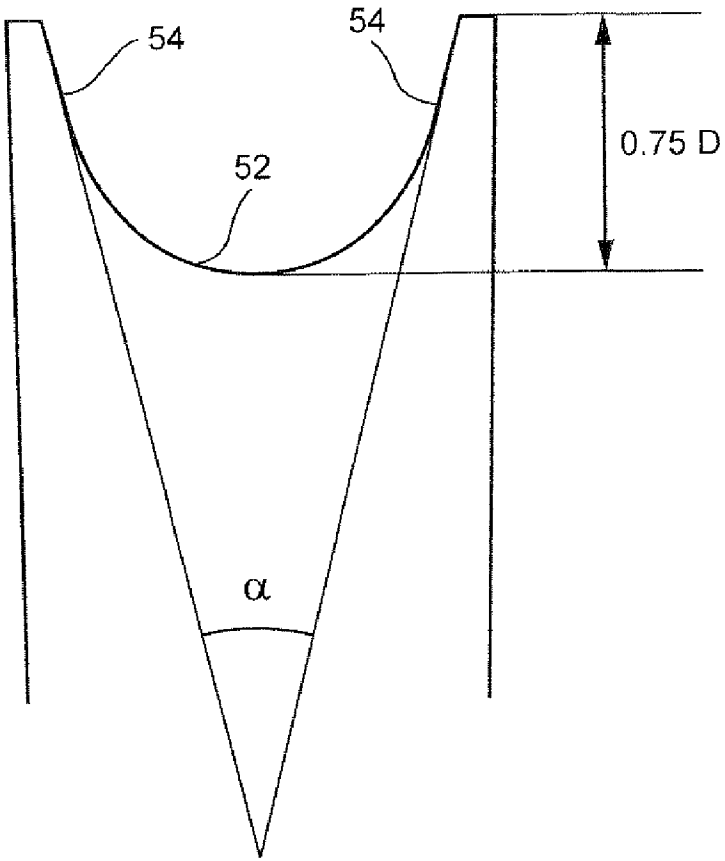
FIG. 3 depicts a groove employed in the sheaves of the test apparatus shown in FIG. 1.

The sheaves comprise a groove as shown in FIG. 3, having a central part 52 of the same diameter as the rope. The flange angle $\alpha$ is 30°, the groove extending in straight parts 54 from both sides of the central part as indicated in FIG. 3. The total depth of the groove is 0.75 times the diameter of the tested rope. The force 26 is 2×22% of the Maximum Break Load (MBL) of the tested rope. The stroke of a cycle is 2.22 times the diameter of a sheave.

The flex fatigue is expressed in the amount of cycles the rope withstands before failure by breaking.

Comparative Experiment A.

A standard rope fitting a 20 mm sheave and consisting entirely of HPPE fibers was produced. As HPPE fibers Dyneema™ SK 75, 2640 dtex was used, delivered by DSM in the Netherlands.

The construction of the rope yarn was 10×2640 dtex, 12 turns per meter S/Z. From the yarns strands were produced. The strand construction was 7 rope yarns, 20 turns per meter Z/S. From the strands a rope was produced. The rope construction was 12 strand braided rope with 6.1 turns per meter (164 mm pitch).

The breaking load of the rope was 40.3 tons.

The flex fatigue of the rope was tested according to the test method as described above.

The sheave diameter was 400 mm. The cycling period was 6.5 seconds. The force applied to the sheave 24 was 2×9.15 tons.

The rope failed after 4145 cycles.

Comparative Experiment B.

The standard rope of comparative experiment A was impregnated with a coating optimized for bend-over-sheave applications.

The flex fatigue was tested under the same conditions as for the rope of comparative experiment A. The rope failed after 18608 cycles.

EXAMPLE 1

A rope that fits a 20 mm sheave according to the invention was produced. The rope comprised a plurality of strands comprising a mixture of the HPPE fibers as used in comparative experiment A (indicated by D in the construction below) and e-PTFE 500 dtex, delivered by Gore in the USA (indicated by G in the construction below).

The construction of the rope yarn was (9×2640 dtex D+9×500 dtex G) with 12 turns per meter S/Z.

The strand construction was 7 rope yarns, 20 turns per meter Z/S and the rope construction was 6.1 turns per meter (164 mm pitch).

The flex fatigue was rested under the same conditions as for the rope of comparative experiment A. The rope failed after 23132 cycles.

EXAMPLE 2

The rope of example 1 was impregnated with the same coating as used for the rope of comparative experiment B.

The flex fatigue was rested under the same conditions as for the rope of comparative experiment A. The rope failed after 123591 cycles.

The invention claimed is:

1. Rope containing a plurality of rope strands comprising a mixture of high-performance polyethylene (HPPE) fibres and polytetrafluoroethylene (PTFE) fibres, and at least one core strand in a core of the rope which consists of HPPE fibres and optionally fibers other than PTFE fibres, wherein the HPPE and PTFE fibres are present in the rope in a total mass ratio of HPPE to PTFE of 70:30 to 98:2.

2. Rope according to claim 1, wherein the rope is of a braided construction.

3. Rope according to claim 1, wherein the rope contains 8 or 12 strands.

4. Rope according to claim 1, wherein the rope has a diameter of at least 30 mm.

5. Rope according to claim 1, wherein the high-performance polyethylene fibres have a tenacity of at least 2.5 N/tex.

6. Rope according to claim 1, wherein the polytetrafluoroethylene fibres have a tenacity of at least 0.3 N/tex.

7. Rope according to claim 1, wherein the mass ratio of HPPE fibres to PTFE fibres is from 80:20 to 95:5.

8. Rope according to claim 1, wherein the rope further contains from about 2 to 20 mass % of silicone compounds.

9. Rope according to claim 1, wherein the rope exhibits a flex fatigue which is improved by at least a factor of 5 compared to the rope not comprising the PTFE fibres.

10. A load-bearing member for bend-over-sheave applications which comprises a rope according to claim 1.

* * * * *